United States Patent [19]

Martens

[11] 4,310,386

[45] Jan. 12, 1982

[54] METHOD OF AND APPARATUS FOR THE DRY QUENCHING OF COKE

[75] Inventor: Theophile Martens, Ertvelde, Belgium

[73] Assignee: Siderurgie Maritime (Maritieme Staalnijverheid) SIDMAR S.A., Ghent, Belgium

[21] Appl. No.: 914,082

[22] Filed: Jun. 9, 1978

[30] Foreign Application Priority Data

Jun. 14, 1977 [LU] Luxembourg ..... 77536

[51] Int. Cl.[3] ..... C10B 39/10; C10B 39/12; C10B 39/16; C10B 57/00

[52] U.S. Cl. ..... 201/39; 202/228; 202/230; 202/267 R

[58] Field of Search ..... 201/18, 39, 42; 202/95, 202/228, 226, 230, 253, 267; 110/171; 432/83, 84; 266/46, 259; 34/13, 20, 86, 218, 219

[56] References Cited

U.S. PATENT DOCUMENTS

| | | | |
|---|---|---|---|
| 2,997,427 | 8/1961 | Mansfield | 202/230 |
| 3,007,850 | 11/1961 | Schmidt | 202/228 |
| 3,043,753 | 7/1962 | Destremps et al. | 201/42 |
| 3,792,769 | 2/1974 | Echterhoff | 202/267 |
| 3,959,084 | 5/1976 | Price | 202/228 |
| 3,966,561 | 6/1976 | Hinkley | 201/32 |

FOREIGN PATENT DOCUMENTS

| | | | |
|---|---|---|---|
| 358604 | 5/1923 | Fed. Rep. of Germany . | |
| 442353 | 6/1924 | Fed. Rep. of Germany . | |
| 421999 | 11/1925 | Fed. Rep. of Germany . | |
| 590049 | 12/1933 | Fed. Rep. of Germany . | |
| 1002727 | 2/1957 | Fed. Rep. of Germany . | |
| 1014071 | 8/1957 | Fed. Rep. of Germany . | |
| 2715223 | 11/1977 | Fed. Rep. of Germany | 202/228 |
| 520389 | 2/1921 | France . | |
| 543578 | 11/1921 | France . | |
| 1196184 | 6/1970 | United Kingdom . | |

OTHER PUBLICATIONS

Griswold, "Fuels, Combustion & Furnaces", p. 415, 1946.

*Primary Examiner*—Bradley Garris
*Attorney, Agent, or Firm*—Karl F. Ross

[57] ABSTRACT

A method of and an apparatus for the dry quenching of coke comprises a band conveyor upon which the coke is transported continuously in a relatively thin layer and enclosed at least in part by a vault of quartz or other heat-transfer material which is sprayed upon its face turned away from the coke with water to produce steam which is continuously removed and used directly or indirectedly as a source of heat.

5 Claims, 3 Drawing Figures

TURBINE
GEN
(THERMAL INSULATION)
SCRUBBER
EVACUATING BLOWER
HOOD
COKE OVEN
VIBRATOR 58

METHOD OF AND APPARATUS FOR THE DRY QUENCHING OF COKE

FIELD OF THE INVENTION

The present invention relates to a method of and to an apparatus for the dry quenching of coke and, more particularly, to a method of and an apparatus for the cooling of coke which is discharged from a coke oven.

BACKGROUND OF THE INVENTION

The principal conventional process for the dry quenching of coke, which is almost six decades old, consists in passing an inert gas in a closed circuit through the incandescent coke discharged from the coke oven into a closed vessel in which heat exchange is effected between the gas and the coke. The closed path for the gas includes a heat exchanger which can be used to generate steam by indirect heat exchange between the hot gas and water. This process has been found to yield coke of excellent quality for blast-furnace use or the like.

The advantage of the dry-quenching process over wet quenching is primarily a consequence of the lesser degree of environmental pollution or disadvantage resulting from the closed gas cycle.

In wet-quenching processes in which the coke is quenched with the aid of jets of water, at least part of the sensible heat of the coke is transformed into thermal energy of evaporation to vaporize the water. The vapors which result from the wet quenching process tend to become atmospheric pollutants and, in addition, residual water, upon separation from the coke, must be treated before it is disposed of.

A further disadvantage of the wet treatment process is that it is accompanied by a significant loss of water by evaporation and by absorption by the coke. The coke quality is reduced in that its mechanical strength is diminished so that it is less able to withstand the rigors of blast-furnace operation. Finally, the wet process gives rise to extremely moist coke fines which must be dried prior to use and agglomeration.

None of the aforementioned disadvantages characterizes the dry-quenching process and hence the dry-quenching process has found application whenever high quality cokes are to be produced.

However, the dry-quenching process has a significant disadvantage in that the gases which traverse the coke mass are charged with considerable quantities of abrasive powders and with coke fines which cause corrosion and erosion problems in the ducts, in the steam generator, and in the blowers used to circulate the gas.

Furthermore, because of the irregular introduction of coke into the cooling silo and discharge from the latter, the production of the steam is also irregular. In other words, greater or lesser quantities of steam are produced to the detriment of effective utilization of the recovered heat.

To overcome at least in part this drawback, it has been proposed to provide a bypass for the heat exchange circulation path which permits mixing of a cold gas with the hot recirculating gas so as to maintain the temperature of the gas more constant as it traverses the steam generator or heat exchanger in which the gas is cooled and the heat carried by the gas is transformed into steam. This is not, however, fully satisfactory.

OBJECTS OF THE INVENTION

It is the principal object of the present invention to provide a method of and an apparatus for the dry quenching of coke which maintains all of the significant advantages of the prior-art dry-quenching processes but which is free from the disadvantages of these earlier systems as mentioned above.

Another object of the invention is to provide an improved method of and apparatus for the dry quenching of coke which enables the more uniform and constant production of the heat-carrying or heat-abstracting gas while precluding environmental pollution.

SUMMARY OF THE INVENTION

These objects and others which will become apparent hereinafter are attained, in accordance with the present invention which comprises, in accordance with a process or method aspect, the step of advancing a relatively thin layer of the hot coke continuously on a transport conveyor generally horizontally beneath a vault of a material facilitating, promoting or inducing the transfer of heat away from the coke by radiation and/or by conduction, the vault being continuously cooled by spraying its surface turned away from the coke with water.

In order to accelerate cooling of the coke on the conveyor belt or band, means can be provided to effect at least partial turning of the coke layer. Such means can include a vibrator for the belt and/or plows, plowshares or mold boards which engage in the layer of coke and tend to turn it over or displace it from side to side.

Because of the fact that the housing through which the coke is passed continuously in the aforementioned layer is closed and thermally insulated toward the exterior and the introduction and discharge of the coke is practically constant as regards the volume flow rate and its temperature, the quantity and temperature of the water vapor produced by contact with the surfaces of the vault vary only to a slight degree and hence the heat carrier can be used without concern for variations in the production rate or temperature of the steam. As opposed to conventional dry-quenching techniques, therefore, the heat carrier, in this case directly produced steam, can be delivered at a constant rate and temperature which was not possible with the earlier dry-quenching technique.

A further advantage of the system of the present invention is that the heat-transporting gas is constituted by water vapor which remains perfectly clean because of the fact that it never comes into direct contact with the incandescent coke. As a result, even loss of steam to the atmosphere will not create a pollution hazard and, in the event any water remains after being sprayed upon the surface of the vault turned away from the coke, this water can be discharged without cleaning.

In accordance with its apparatus aspects, the invention comprises an installation for carrying out the aforementioned process and which includes a housing which is closed and thermally insulated toward the exterior or the ambient environment. Within this housing there is provided a movable conveyor for the coke to be cooled, a vault closely spaced from the layer and preferably disposed immediately thereabove over at least a portion of the length of the conveyor and capable of picking up heat by radiation or convection from the coke and transferring the heat through the wall of the vault, and a vapor-generation chamber within the housing separated from the coke by the vault. Means is provided for spraying the surface of the vault within the housing with the water which is to be transformed into steam.

The apparatus can comprise, also within the housing, a silo or hopper for the intermediate storage of the incandescent coke as well as means for depositing the intermediate-stored coke continuously onto the transport conveyor. The latter may communicate with means for discharging the coke including, for example, means for subsequent treatment of the cooled coke, e.g. a riddle or screen for separating the coke into fractions of different particle size.

The vault for the transfer of the heat radiantly or convectively picked up from the coke is preferably constituted of a transparent material with a low coefficient of thermal expansion and contraction, preferably quartz. The quartz vault can be constituted of blocks, tubes or rods and seals the vapor-generating space from the chamber through which the coke is advanced on the conveyor. Naturally, the vault can also be constituted of a material having a high thermal conductivity, this material being metal, glass or ceramic.

In accordance with the best mode currently known to me for carrying out the invention in practice, the vault consists of quartz rods, bars or blocks.

An installation of the type described has been found to be capable of integration easily into existing coke-production facilities and to be readily incorporatable into coke-production plants under construction or to be built. The apparatus guarantees an excellent cooling rate as well as a continuous and direct production of vapor and, where the vapor (steam) is used to drive an electric power generator a continuous supply of electric current. Furthermore, the system operates with excellent water economy.

The system completely eliminates or greatly simplifies the purification of water and the heat-carrying gas, namely, steam which is produced.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

Figures 1, 2, 3:
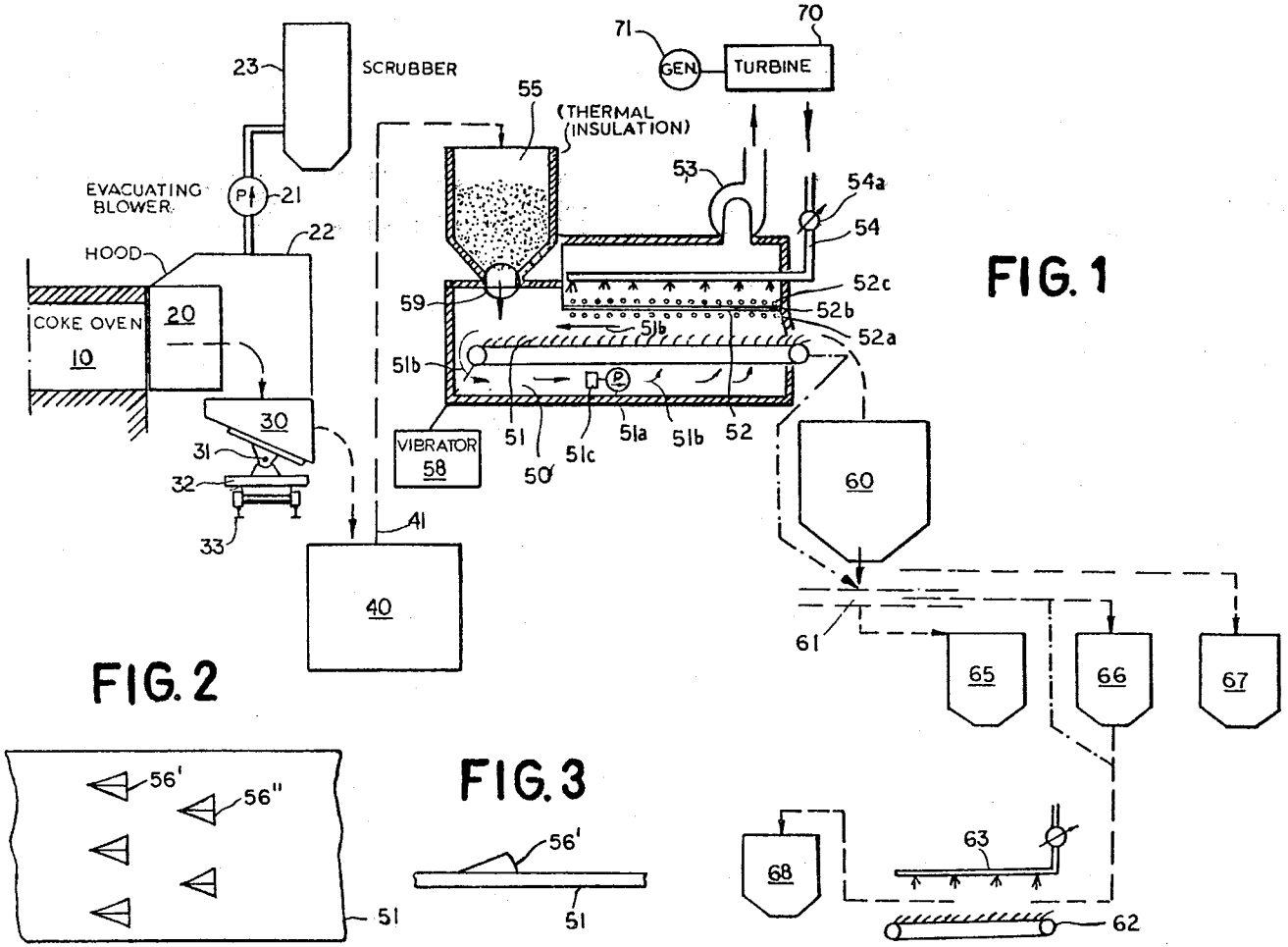
FIG. 1 is a flow diagram illustrating an apparatus for carrying out the present invention in accordance with the best mode currently known to us.
FIG. 2 is a plan view showing the coke-turning means which can be used with the conveyor of FIG. 1.
FIG. 3 is a side elevational view of a portion of the conveyor belt provided with the coke-turning means of FIG. 2.

The incandescent coke which is driven out of the coke oven 10 at a temperature of 950° to 1150° C., is collected in a transport bucket 30 which is tiltable about a pivot 31 on a bogey 32 riding along tracks 33.

The discharge of the coke from the coke oven is effected by conventional means from the individual coke oven chamber preferably under an evacuated hood which can be displaced from chamber to chamber along with the coke guide 20 and the bucket 30 so that the coke never comes into direct contact with the atmosphere and the vapors, gases or particles which may be discharged from the body of the coke pushed out of the furnace are drawn away by the evacuating pump 21. Such a hood has been shown diagrammatically at 22.

This hood can be connected, in addition to the evacuating blower 21, with a wet scrubber 23 for the gases so that the polluting emissions upon discharge of the furnace are completely controlled.

The transfer bucket 30 can be emptied into a storage silo 40 constituted by a reinforced or plated tank lined with a refractory. Means, e.g. a further hood, can be provided at the transfer region so that the discharge of the transfer bucket 30 into the storage silo 40 can be effected without release of powder into the surrounding atmosphere.

A transport elevator continuously or intermittently lifts the incandescent coke, as represented by the broken line 41, to the silo 55 which forms part of the cooling unit. The elevator 41 can also be enclosed and evacuated to prevent release of gases or particulates into the atmosphere.

The silo 55 can form part of the thermally insulated housing of the cooling apparatus. It is preferably provided on its bottom with a metering device 59 for depositing the coke in a thin layer continuously on a metal transport conveyor 51 whose horizontal stretch passes beneath a heat exchange vault 52. The height of the layer on the transport band should be between 15 and 20 centimeters.

Because of the low thermal conductivity of the coke, to promote heat transfer therefrom, means can be provided to turn the coke layer. Advantageously, this means includes a vibrator 58 for the transport band 51 and a plurality of plows or mold boards 56', 56'' disposed along the path of the conveyor 51 as shown in FIGS. 2 and 3 to turn the coke layer and activate or promote the heat transfer.

When, as is preferably the case, the band is perforated or in the form of a screen, a blower **51*a* can be provided to circulate a current of inert gas through the layer from bottom to top and in the direction of the vault as represented by the arrows 51*b***.

The cooling transport band 51 and the vault 52 are both contained within a closed housing 50 which is thermally insulated toward the exterior, as shown, and which is practically sealed so that the loss of heat toward the exterior as well as the release of coke dust is minimized. The housing 50 can be provided with a device for removing dust particles, e.g. a filter **51*c* upstream of the blower 51*a***.

The heat exchange wall constituted by the vault 52 is preferably formed by a network or grid of quartz bars. As shown, the wall is constituted by bars **52*a* running perpendicular to the plane of the paper and horizontally parallel to the conveyor, bars 52*b* running parallel to the path of the conveyor and bars 52*c* also extending perpendicular to the plane of the paper in FIG. 1. While the bars have been shown spaced apart in FIG. 1**, it will be understood that they are adjacent one another in each of the parallel arrays so as to prevent escape of dust through the quartz barrier into the heat exchange chamber. The provision of bars in the manner described facilitates heat exchange to the cooling fluid.

Cold water, distributed by the spray conduit 54 and trickle or spray heads, is brought into contact with the hot wall along the surface turned away from the coke and is transformed into steam which can be used directly or in a closed heat-transport cycle for heat transfer to another fluid medium.

The steam is completely clean and thus can be discharged without the danger of environmental pollution.

The quantity of hot coke displaced through the housing per unit of time is easily kept constant by the conveyor to ensure an absolutely continuous supply of steam at a given temperature and a practically constant volumetric rate of flow. A blower 53 evacuates steam from the chamber of the housing formed above the vault 52. The steam can be delivered to a turbine 70 which can drive an electric current generator 71. The depleted water can be returned via the control valve 54*a* to the spray conduit 54.

During its passage through the housing 50, the coke is cooled at least to 400° C. The residence time in the housing is on the order of 12 to 20 minutes. A band having a length of 80 meters and a width of 2 meters is able to carry 400 tons of coke per day through the cooling process with a thickness of the charge of about 20 centimeters.

Upon discharge from the transport conveyor 51, the coke can be subjected to hot size classification on the riddle 61 as represented by dot-dash lines or can be stored in a silo 60 and then subjected to size classification as represented by broken lines. The various size fractions can be stored in the classification silos 65, 66 and 67. More particularly, the fine fraction with a particle size between 0 and 20 millimeters can be stored in the silo 65, the intermediate fraction of 20–20 millimeters can be stored in the silo 66 and the coarse fraction of a particle size greater than 40 millimeters can be stored in the silo 67.

The fine coke fraction (coke dust) with a particle size between 0 and 20 millimeters is burned and used as a combustible for the agglomeration of iron core. The coke fraction with a particle size between 20 and 40 millimeters, which is intended for use in the blast furnace, is preferably treated with a controlled quantity of milk of lime or dolomite sprayed from a conduit 63 before being introduced into the blast furnace. This prevents premature gasification in the blast furnace.

Preferably, this treatment can be effected on a conveyor belt 62 whereupon the treated coke is stored in a silo 68 and can be mixed directly with the fraction with a particle size over 40 millimeters. Naturally, instead of intermediate storage at 66, the particle size fraction between 20 and 40 millimeters can be introduced directly from the riddle to the conveyor 62.

All of the operations shown, including the size classification on the riddle 61, the storage in the silos 60, 65–67, 68 and the treatment with milk of lime or dolomite can be effected under hoods to ensure capture of all dusts which may be produced.

I claim:

1. A process for the dry quenching of coke, comprising the steps of:

passing the incandescent coke on a generally horizontal transport surface in a continuous layer beneath a heat exchange wall, thereby transferring heat to said wall in a closed housing, the wall conducting the heat to a surface turned away from the coke;

spraying said surface of said wall with water to generate steam in said housing in a chamber thereof separated by the wall from the coke, the layer of coke being displaced on a continuous transport band beneath said wall and said wall forming a vault overlying said band;

displacing the particles of coke on the band during their passage beneath the vault; and at least toward the end of the passage of the coke layer beneath the vault, passing an inert gas through the layer upwardly in the direction of said vault.

2. The process defined in claim 1, further comprising the step of storing the cooled coke upon its discharge from said band in a storage silo.

3. The process defined in claim 1, further comprising the step of subjecting the coke cooled on said band to a particle-size classification.

4. The process defined in claim 3, further comprising recovering particles of a predetermined size range from said particle size classification and treating same with a spray of milk of lime or dolomite.

5. An apparatus for the dry quenching of coke comprising:

a thermally insulated elongated closed housing having an inlet end and an outlet end;

a transport conveyor band in said housing having a horizontal stretch extending between said inlet end and said outlet end;

a vault of a thermally conductive material spacedly overlying said band and adapted to be juxtaposed with a layer of coke disposed on said band so as to conduct heat away from said layer of coke;

means at said inlet end for depositing said coke in a layer on said band;

means in said housing for spraying a surface of said vault turned away from said band with water to generate steam in said housing in a compartment thereof separated by said vault from said coke, said vault being constituted by a transparent material of low coefficient of thermal expansion, said material being quartz and said means for depositing the coke in said layer on said band comprising a storage silo at said inlet of said housing, the means for spraying the surface of said vault turned away from said band with water comprising a sprayer for spraying water onto said surface of said vault turned away from said band;

means for turning the layer of coke on said band while it passes beneath said vault;

a riddle for receiving cooled coke from said band and separating the cooled coke into a plurality of particle sizes;

means for collecting the respective particle sizefractions; and means for treating at least one of said particle size fractions with milk of lime or dolomite.

* * * * *